United States Patent [19]

Sandor

[11] Patent Number: 4,582,484

[45] Date of Patent: Apr. 15, 1986

[54] SPIRAL TRACK OVEN

[76] Inventor: Drobilisch Sandor, 15362 Elm Park, Monte Sereno, Calif. 95030

[21] Appl. No.: 707,028

[22] Filed: Feb. 28, 1985

[51] Int. Cl.[4] ..... F27B 9/14; F26B 9/00

[52] U.S. Cl. ..... 432/134; 34/164

[58] Field of Search ..... 432/11, 134; 34/164; 219/388; 99/443 C

[56] References Cited

U.S. PATENT DOCUMENTS

| | | | |
|---|---|---|---|
| 3,343,812 | 9/1967 | Moulton | 34/164 |
| 3,868,213 | 2/1975 | Shulika et al. | 34/164 |
| 4,191,881 | 3/1980 | Ahlgren et al. | 219/388 |
| 4,237,622 | 9/1980 | Francis | 34/164 |
| 4,416,624 | 11/1983 | Bloom | 432/134 |

*Primary Examiner*—John J. Camby

*Attorney, Agent, or Firm*—Thomas Schneck

[57] ABSTRACT

A spiral track oven has a heated spiral track on which semiconductor chip bases move. A jarring motion about the central axis of the track supplies inertia to the bases, moving them down the track. A blanket-like laminated heater on the inside of the track supplies heat to the bases. Excess heat is vented by positive airflow out a vent. A perforated screen-like shroud wrapped around the outside of the track keeps the bases from falling off the track while allowing excess heat to escape. A pneumatic or hydraulic drive shaft extends through a table to the base of the oven where it is mounted. The drive and driveshaft turn the oven back and forth about a central shaft gently in one direction and in a jarring motion in the other, thereby supplying inertia to the bases.

8 Claims, 3 Drawing Figures

SPIRAL TRACK OVEN

DESCRIPTION

TECHNICAL FIELD

The invention relates to an oven and in particular to a spiral track oven for the continuous processing of semiconductor mounting bases.

BACKGROUND ART

In the manufacture of semiconductor integrated circuits, chips are placed on heated bases at some time in the manufacturing process. A heat absorbing cover is placed over the chip, sealing the chip from damage causing dust. Many of these steps call for baking, to drive off volatile gases from the glues, for example. Currently, the industry uses batch processing to accomplish the baking steps. Bases are placed on metal trays and placed in an oven for a set period of time. When the baking is finished, the trays are removed and the next processing step can proceed.

Many steps in the production of completed chips on bases are done using assembly line techniques, and the industry is beginning to use robotics to automate the process. However, the baking steps are still done using batch processing, which interrupts the assembly line flow of products. The baking step must wait until enough bases are accumulated from the prior step. The succeeding step must wait until the baking is completed. Since the baking step can take thirty or more minutes, the interruption in assembly line flow can be a serious problem.

A second problem associated with batch processing is that humans must handle the chips. This introduces particulate matter which can ruin a chip. Every effort is made to keep the chips clean during processing. Clean rooms keep out much of the dirt and dust, and chips are washed regularly with solvent. Yet, an excessive number of chips are still ruined by the effects of particles. Replacing the batch processing of chips during the baking steps involving bases by an assembly line technique would reduce the number of times the chips are handled.

It is accordingly, an object of the present invention to produce an oven that continuously processes semiconductor chips and their bases.

It is a further object of the invention to produce an oven that is compact, efficient, and inexpensive.

DISCLOSURE OF INVENTION

These objects have been achieved in a spiral track oven having, a smooth, heat conducting, spiral track on which bases in a chip manufacturing operation slide. The bases are usually ceramic members which move. Motion of the bases is achieved by supplying a jarring motion about a vertical axis of the spiral track so that inertia is supplied to the bases, thereby moving them by sliding motion on the track.

Bases to be baked enter the oven at the top end of a spiral track. The track is heated through a heat conducting inner cylindrical wall, on the inside of the track, by a blanket-like heater element laminated to the cylindrical wall. A series of jarring-type motions of the oven about the axis of the track conveys the bases by inertial motion downwardly along the track. The bases are baked as they travel along the track and finally emerge from the oven at the bottom of the track. Excess heat is vented by positive airflow out of a vent. The length of the spiral track, the amplitude, impulse and frequency of the jarring motion, determine the amount of time the bases remain in the oven.

One end of the spiral track begins near the top of the oven and the other end of the track ends near the bottom of the oven. The track is attached to the outside of a heat conducting cylinder having the same vertically aligned axis as the track. A blanket-like laminated heater element in intimate contact with the inside surface of the cylinder wall provides heat to the track through the heat conducting wall. A heat insulating circular top and floor of the oven are attached to the edges of the cylindrical wall. A perforated screen-type shroud is wrapped around the spiral track and secured to the top and floor. This shroud has openings at each end of the spiral track for the entrance and exit of the chips into and out of the oven and serves to confine heat within the oven.

The oven has a vertically aligned central shaft positioned on the axis of the cylinder wall, which extends through the centers of top and floor. Bearings allow the spiral track oven to move back and forth about the central shaft in a jarring motion. A stationary vent shroud, having a cylindrical lower part and conical upper part, is secured at its lower end to a table and terminates at its upper end in a circular vent. The lower cylindrical part of the vent shroud is spaced around the perforated shroud of the oven. Excess heat is conducted by positive airflow between the two shrouds up through the vent.

A drive shaft extends vertically through a table hole and is mounted to the base. This shaft connects with a pneumatic, hydraulic or electric drive mounted beneath the table for applying an appropriate rotational impulse in one direction only. The drive and drive shaft turn the oven about the central shaft gently in one direction and in a jarring, impulse motion in the opposite direction. The directions are chosen so that the bases move along the track in a downward direction from beginning to end.

BEST MODE FOR CARRYING OUT THE INVENTION

Figure 1:
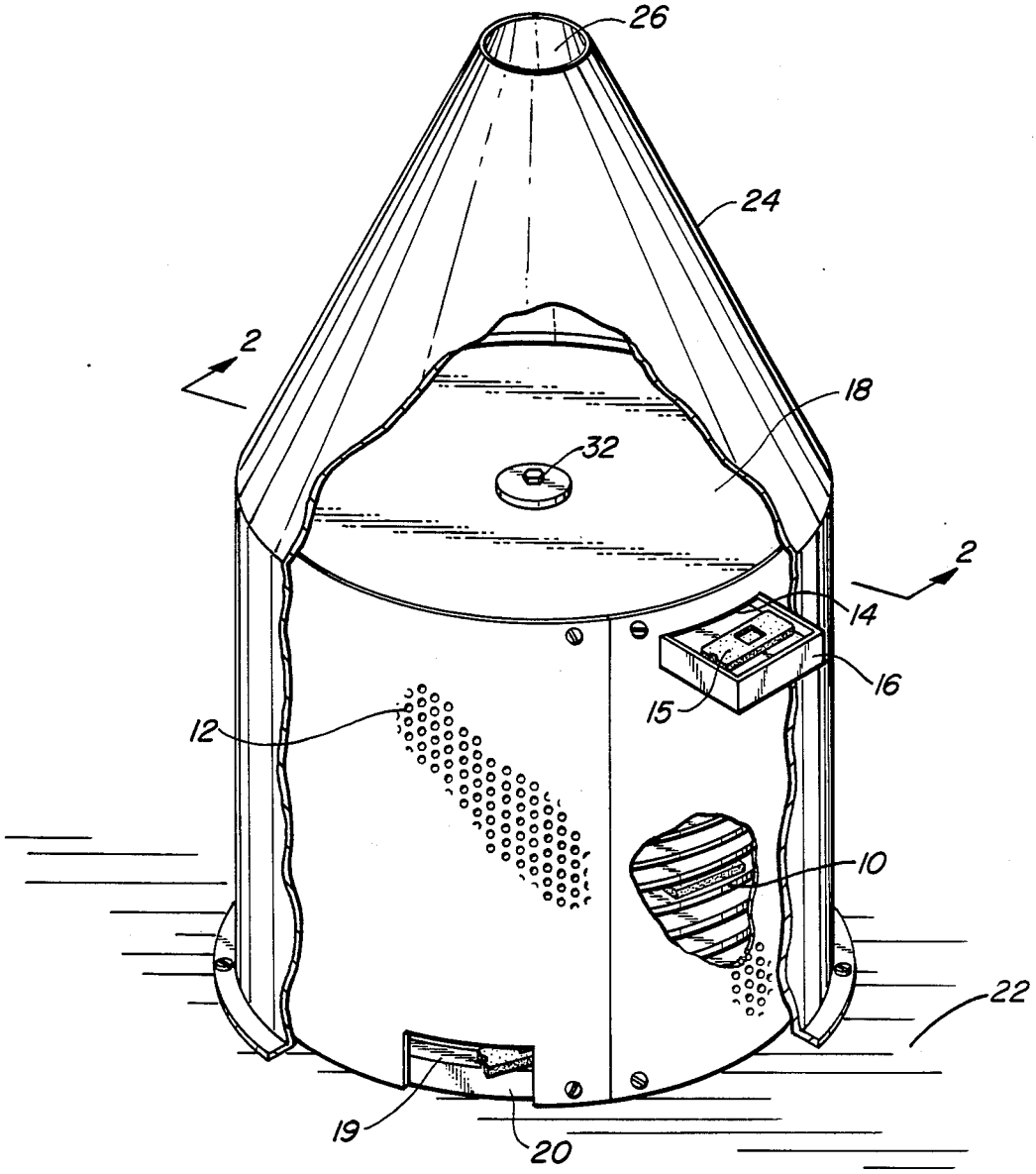
FIG. 1 is a perspective cut-away view of the spiral oven of the present invention.

With reference to FIG. 1, a heated spiral track 10 having vertically aligned central axis is given a series of periodic reciprocating jarring motions about the central shaft 32, indicated by arrows A. Motion is jerky in one direction, smooth in the reverse direction. In this way the bases enter the beginning of the track at entrance 14, located just beneath heat insulating top 18, are imparted with inertia due to a series of impulses in on direction only which moves them downwardly along the track, where they are baked until they reach the end of the track at exit 19, located just above heat insulating floor 20. Entrance 14 is a base inlet region for supplying the track. A small platform 16 may be provided for assisting loading of bases. In this case, a base 15 is shown on platform 16. The base is pushed inwardly onto the spiral track and then a new base is loaded onto the platform.

Essential heat is retained in the vicinity of the track, and the base motion is constrained to the track 10 by a perforated screen like shroud 12 wrapped around the spiral track 10. A stationary vent shroud 24 is secured to table 22 and is spaced around perforated shroud 12. The vent shroud 24 has a cylindrical lower part and conical upper part. Excess heat is eliminated by positive air flow between the two shrouds 12 and 24 then through vent 26.

Figure 1A:
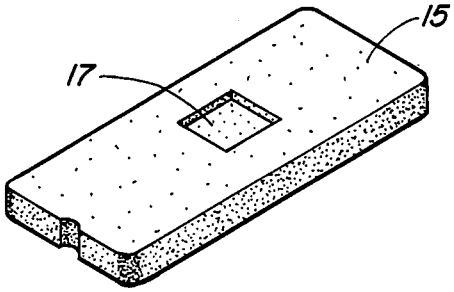
FIG. 1*a* is a perspective view of a base of the type which moves in the spiral oven of FIG. 1.

In FIG. 1*a*, a ceramic base 15 is seen to be a solid, box-like structure, about one inch long and less than one-half inch wide. The base includes a recess 17 where a chip may be mounted, as by adhesive. The base has a smooth bottom so that it can slide along the smooth spiral track.

Figure 2:
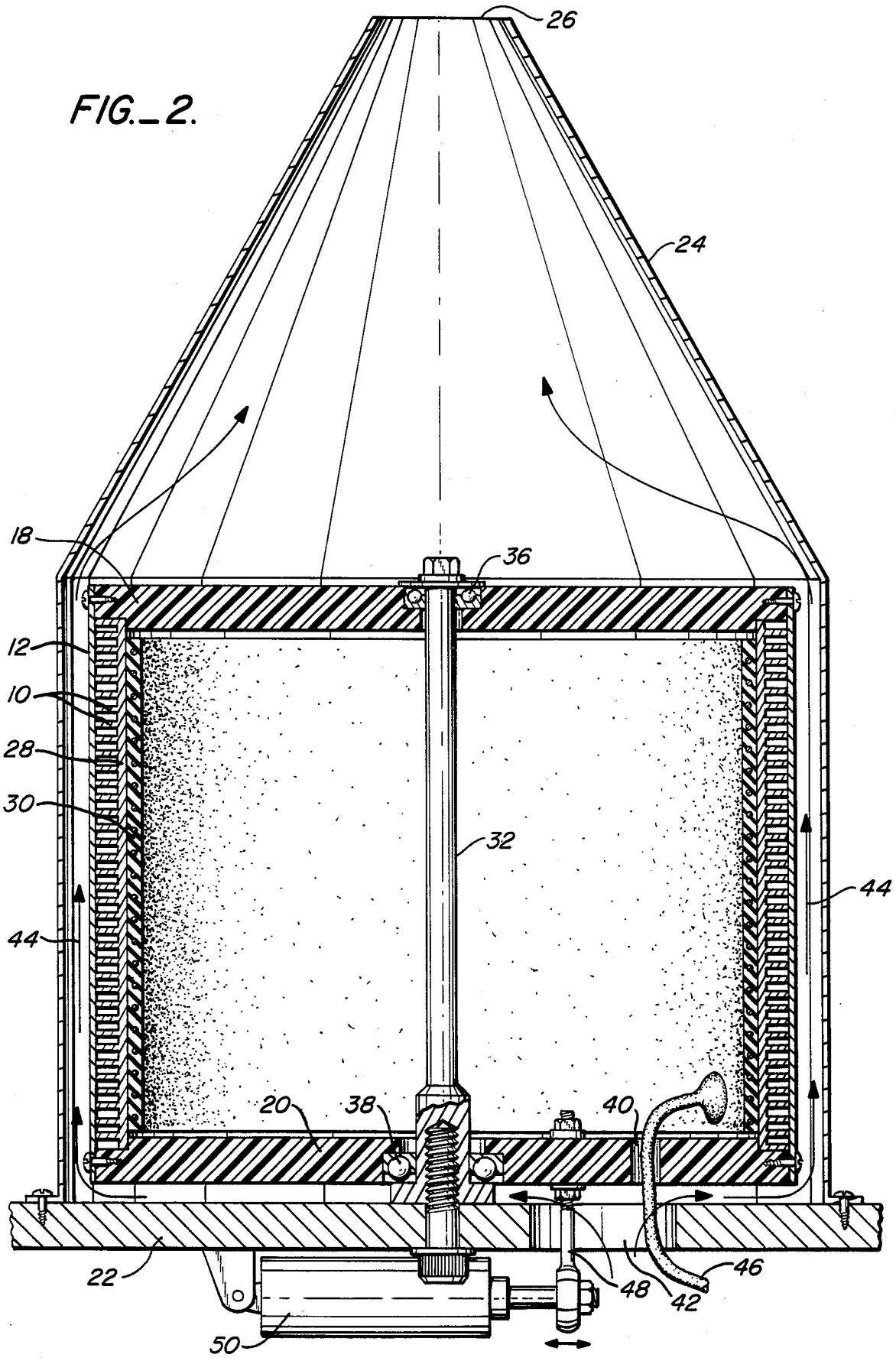
FIG. 2 shows a cross-section of the oven taken along the direcion 2–2′ in FIG. 1.

With reference to FIG. 2, a horizontal spiral track 10 has a vertically aligned axis. One end of track 10 begins near the heat insulating top and the other end of the track 10 ends near the heat insulating floor 20. The track can be any heat conducting metal such as aluminum. The track's length is a principal determiner in the amount of time that the chips are baked. Longer tracks mean a longer baking time. The size of the oven depends on the size of the chip package bases. For 0.300" wide cerdip bases, the spiral track typically is ¼" wide with ⅛" between levels, and with a diameter of about 8". The heat insulating top and floor may be made out of any heat insulating, heat resistant material such as Delrin, a trademark of DuPont Company for a tough heat resistant polymer.

The track 10 is formed into the outside wall of a heat conducting cylinder, as part of an outer wall 28 having the same vertically aligned axis as the track. The wall 28 may be made of any heat conducting material such as aluminum, with surface treatment to ensure low friction between the track 10 and ceramic chip bases. Preferably, the wall 28 and spiral track 10 are made as one integral structure. A blanket-like laminated heater element 30 in intimate contact with the inside surface of wall 28 provides heat to the track 10 through the heat conducting wall 28. Wire leads 46 provide the electricity for the heater 30.

A perforated screen-type shroud 12 is wrapped around the spiral track 10 and secured to the circular top 18 and floor 20. The shroud 12 has openings at each end of the spiral track 10 for the entrance and exit of bases into and out of the oven. The shroud 12 is typically divided into five or six separately secured pieces for easy removal. Typically screws are used to secure the pieces to the top 18 and base 20. The shroud 12 helps to maintain chip bases on the track 10, and it also keeps most of the heat next to the chips. The perforations on the shroud 12 allow excess heat and volatiles to escape.

The oven has a vertically aligned central shaft 32 positioned on the axis of the cylindrical wall 28 and spiral track 10. The central shaft 32 extends through the centers of circular top 18 and floor 20. A first bearing 36 movably connects the top 18 and central shaft 32. A second bearing 38 movably connects the base 20 and central shaft 32. The shaft 32 has a flanged bottom 34 bolted to table 22. The flange 34 is immediately beneath the second bearing 38 and supports movably the floor 20 of the oven spaced above table 22.

A stationary vent shroud 24 is spaced around the perforated shroud 12. The vent shroud 24 has a cylindrical lower part and conical upper part terminating in a vent 26. Air 44 flows through a hole 42 in the table 22, upwards between the perforated shroud 12 and vent shroud 12, and out the vent. In this way, excess heat and volatiles are allowed to escape. The airflow 44, and consequently the amount of heat loss, is controlled by the vent opening 26. The vent shroud is typically metal and screwed to the table 22.

The floor and table have holes 40 and 42 off-center from the axis. The floor hole 40 is somewhat smaller than the table hole 42, and the floor hole 40 is usually slightly further from the axis than the table hole 42. Otherwise, the holes 40 and 42 are generally aligned with each other. As noted before, the table hole 42 allows cooling air 44 to flow between the two shrouds 12 and 24. Wire leads 46 extend through both holes 40 and 42 to provide electrical connections to the blanket heater 30.

A drive shaft 48 extends vertically through the table hole 42 and is bolted to the base 20. The shaft is connected to a pneumatic or hydraulic drive 50. Other types of drives such as electric motors, may also be used. The drive 50 moves the drive shaft 48 in a jarring unidirectional motion, imparting an impulse in one direction, but a smooth, slow return motion.

The direction for unidirectional motion is chosen so the the bases move along the track in a downward direction from beginning to end. Looking from the top of the oven, if the spiral track 10 goes down in the clockwise direction, then a gentle turn in the counterclockwise direction followed by a jarring impulse in the clockwise direction will move the chips in the downward or forward direction. Likewise, if the spiral track 10 goes down in the counterclockwise direction then a jarring motion in the counterclockwise direction is called for. The amount and frequency of impulse and thus jarring is a major factor in determining the length of time that the chips will spend in the oven. Preferably, the bases will move their own length with each jarring motion. Additionally, one base will be placed in the oven, while another base exits the oven with each jarring motion.

I claim:

1. A spiral track oven comprising, a smooth downwardly sloping heat conducting spiral track, having dimensions for supporting chip bases of a characteristic length and having a top and a bottom, a means for supplying a series of jarring unidirectional impulse motions about the axis of said spiral track, thereby imparting inertia to the chip bases being induced to slide a distance of at least their length per jarring motion along said track in the downwardly sloping direction, said means for supplying jarring motions also supplying a smooth return motion in the opposite direction after each jarring motion, a means for maintaining said chip bases on said track, an inlet region associated with the top of the spiral track for the continuous introduction of chip bases onto said track, an outlet region associated with the bottom of the spiral track for the continuous removal of chip bases from said track, and a means for heating said spiral track and a means for venting excess heat.

2. The oven of claim 1 wherein the means for supplying a series of jarring motions comprises, a central shaft positioned on the axis of said spiral track and attached to said spiral track, and a drive with a shaft mounted to said spiral track, said drive imparting an impulse via said shaft to said track about said central shaft.

3. The oven of claim 1 wherein said means for maintaining said chip bases on said track comprises a perforated screen-type shroud on one edge of said spiral track.

4. The oven of claim 1 where said means of venting excess heat comprises a stationary vent shroud surrounding the spiral tack and having a cylindrical lower part and conical upper part, terminating at its upper end in a circular vent, said lower part of vent shroud being spaced around said means for maintaining said bases on said track.

5. A spiral track oven comprising, a heat conducting cylindrical wall having vertically aligned axis, a blanket-like laminated heater element in contact with the inside of said wall, a horizontal spiral heat conducting track on the outside of said wall, one end of said track beginning near the top of said wall and the other end of said track ending near the bottom of said wall, a heat insulating circular base attached to the bottom edge of said cylindrical wall, having a hole off-center, space above the table, said table having a hole beneath said hole of said base, a heat insulating circular top attached to the top edge of said cylindrical wall, a perforated screen-type shroud wrapped around said spiral track and secured to said base and said top, said shroud having openings at each of said ends of said track, a central shaft positioned on the axis of the cylindrical wall, extending through said base and said top, having a flange end screwed to said table and supporting said base above said table, a first bearing movably connecting said top and said central shaft, a second bearing immediately above said flange movably connecting said base and said central shaft, a stationary vent shroud having cylindrical lower part and conical upper part, secured at its lower end to said table, and terminating at its upper end in a circular vent, said lower part of said vent shroud being spaced around said perforated shroud, wire leads extending through said hole of said table and said hole of said base for electrical connection to said heater element, and a drive mounted beneath said table, terminating in a shaft, said shaft extending vertically through said hole of said table and mounted to said base, for turning said oven about said central shaft in the opposite direction, said direction of jarring being in the direction in which said spiral track turns downward.

6. The oven of claim 1 where said drive is hydraulic.

7. The oven of claim 1 where said drive is pneumatic.

8. The oven of claim 1 where said drive is electric.

* * * * *

UNITED STATES PATENT AND TRADEMARK OFFICE

CERTIFICATE OF CORRECTION

PATENT NO. : 4,582,484

DATED : April 15, 1986

INVENTOR(S) : Sandor Drobilisch

It is certified that error appears in the above—identified patent and that said Letters Patent is hereby corrected as shown below:

Page 1 under "United States Patent [9]" the name "Sandor" should read - -Drobilisch- -.

Page 1 following "[76] Inventor", "Drobilisch Sandor" should read - -Sandor Drobilisch- -.

Claim 4, line 3 the words "the spiral tack" should read - -the spiral track- -.

Signed and Sealed this

*Fifteenth* Day of *July 1986*

[SEAL]

*Attest:*

*Attesting Officer*

DONALD J. QUIGG

*Commissioner of Patents and Trademarks*